United States Patent [19]

Hine

[11] 3,957,649

[45] May 18, 1976

[54] WASHER OR HYDRO-EXTRACTORS

[75] Inventor: Gordon Leslie Hine, Huddersfield, England

[73] Assignee: Thomas Broadbent & Sons Limited, Huddersfield, England

[22] Filed: Dec. 11, 1974

[21] Appl. No.: 531,841

[30] Foreign Application Priority Data

Dec. 12, 1973 United Kingdom..... 57512/73
Sept. 14, 1974 United Kingdom..... 40138/74

[52] U.S. Cl...... 210/376; 210/407
[51] Int. Cl.[2]..... B01D 33/00
[58] Field of Search ..... 210/372, 374, 375, 376, 210/380, 407; 233/1 E, 2

[56] References Cited

UNITED STATES PATENTS 2,867,106 1/1959 Stone, Jr. et al..... 210/375
3,613,892 10/1971 Ziller ..... 210/374

FOREIGN PATENTS OR APPLICATIONS 1,432,902 8/1971 Germany ..... 210/376

*Primary Examiner*—Charles N. Hart
*Assistant Examiner*—Ernest G. Therkorn
*Attorney, Agent, or Firm*—Beveridge, DeGrandi, Kline & Lunsford

[57] ABSTRACT

In accordance with the present invention there is provided a washer or fluid extractor comprising a cylindrical basket adapted to be rotated about its longitudinal axis for fluid extracting operations on material placed therein, at least one rope, or other elongate flexible member, extending between a first location in the region of the basket mouth and a second location in the central region of the basket base, the rope tension being selectively adjustable such that, when centrifuging, the rope can take up the profile of the basket interior but, when centrifuging is terminated, the rope can be tightened so that it is displaced inwardly of the cylindrical wall of the basket whereby to dislodge centrifuged material therefrom, means being provided for preventing entanglement of material in the basket with the rope.

9 Claims, 5 Drawing Figures

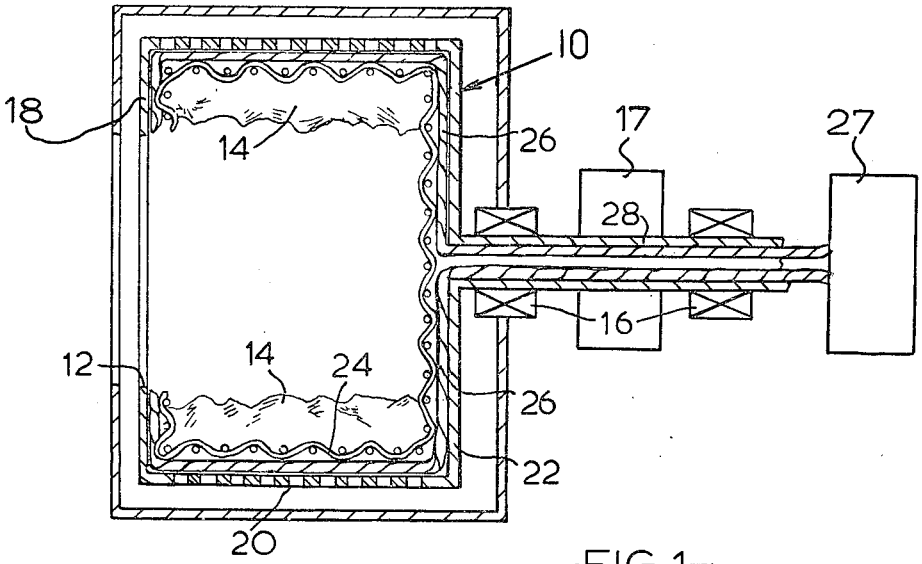
-FIG.1-
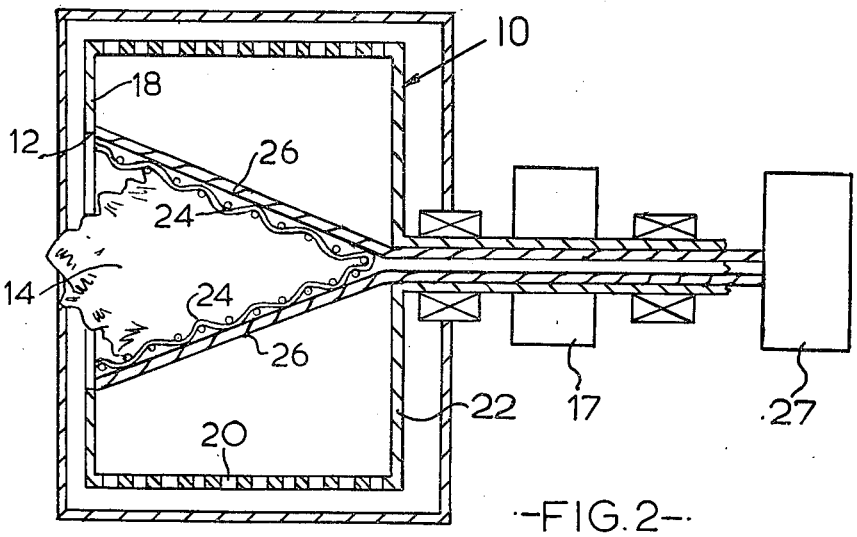
-FIG.2-

WASHER OR HYDRO-EXTRACTORS

The present invention relates to washer or fluid extractors of the centrifugal type in which a load of laundry is rotated at high speed in a perforated basket for the purpose of extracting fluid from the laundry by centrifugal force.

After high speed extraction of fluid (normally water) from a load of laundry in a cylindrical rotary basket, the load forms a solid "cake" on the inside wall of the basket which will usually not collapse under its own weight. The load has therefore to be stripped off the basket wall by some means, usually by hand.

An object of the present invention is to provide a means of stripping such cake from the inside wall of the basket which is more convenient and efficient than the previous manual methods and which permits a completely automatic system to be achieved.

In accordance with the present invention there is provided a washer or fluid extractor comprising a cylindrical basket adapted to be rotated about its longitudinal axis for fluid extracting operations on material placed therein, at least one rope, or other elongate flexible member, extending between a first location in the region of the basket mouth and a second location in the central region of the basket base, the rope tension being selectively adjustable such that, when centrifuging, the rope can take up the profile of the basket interior but, when centrifuging is terminated, the rope can be tightened so that it is displaced inwardly of the cylindrical wall of the basket whereby to dislodge centrifugal material therefrom, means being provided for preventing entanglement of material in the basket with the rope.

In one embodiment, said means for preventing entanglement comprises a respective length of flexible material fitted between the or each rope and the internal walls of the basket.

In another embodiment, said means for preventing entanglement comprises a perforated lining bag located within the basket and of dimensions such that it can substantially take up the profile of the interior of the basket during centrifuging, the open mouth of the bag being attached to the basket in the region of the basket mouth with the rope or ropes lying in between the bag and the internal surfaces of the basket.

The invention is described further hereinafter, by way of example, with reference to the accompanying drawings, in which:

FIG. 1 is a diagrammatic, sectional side elevation of a first embodiment of a washer extractor constructed in accordance with the present invention;

FIG. 2 is a diagrammatic sectional side elevation similar to FIG. 1 but showing the lining bag in its activated position;

Figure 3:
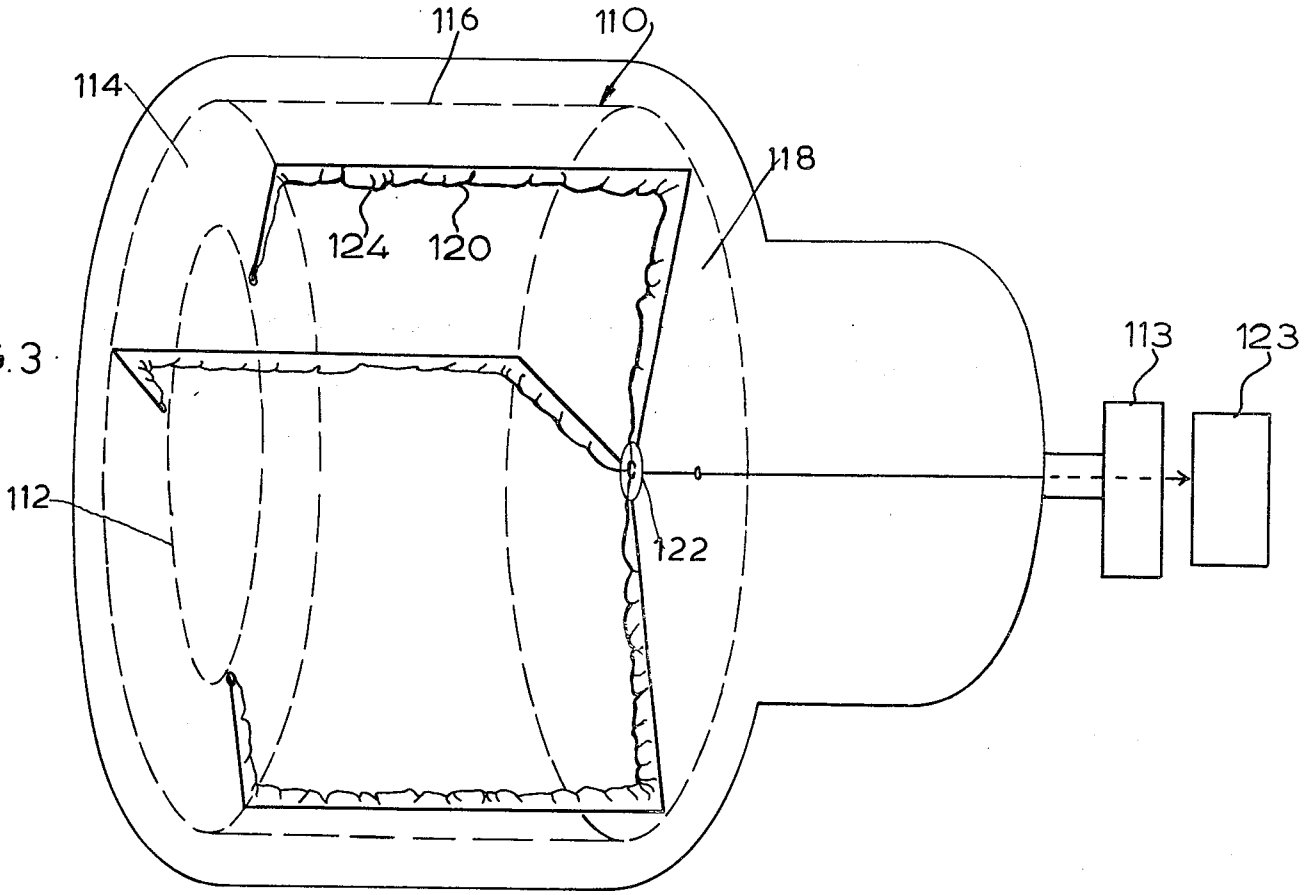
FIG. 3 is a diagrammatic, perspective view of a second embodiment of a washer extractor constructed in accordance with the present invention.

The embodiment illustrated in FIGS. 1 and 2 comprises an extractor basket 10, shown diagrammatically in the drawings, having an open mouth 12 for the insertion and removal of a load 14 of laundry and is adapted to be rotated about a horizontal axis in a conventional manner in bearings 16 by a motor 17. The interior of the basket 10 is defined by an annular, radially extending front wall 18, a cylindrical side wall 20 and a circular, radially extending rear or base wall 22, the cylindrical side wall 20 being perforated to allow centrifuged fluid to pass therethrough during operation of the extractor.

A perforated lining bag 24 of any suitable material is fitted inside the basket 10, the open end of the bag 24 being continuously secured around the basket opening 12 so as to prevent laundry getting behind the bag. The bag 24 is also secured along its length to the cylindrical wall 20 of the basket by a plurality of lifters or beaters (not shown) which are equally spaced in a circumferential direction. Lifters or beaters are conventionally provided in extractor baskets and usually comprise protrusions of triangular cross-section fixed to the cylindrical side wall of the basket interior and facing radially inwards, their function being to assist in the agitation of goods during washing. In the present case, the bag 24 is located between the lifters and the wall 22 so that the lifters act as clamping devices holding the bag to the basket shell.

A plurality of ropes 26, preferably equal in number to or multiples of the number of lifters, are located behind the lining bag 24, i.e. between the lining bag 24 and the internal walls 18, 20, 22 of the extractor basket 10. One end of each of the ropes 26 is secured to the basket in the region of the opening 12, the other ends of the ropes passing through an aperture in the central region of the rear wall 26 and the spindle 28 carrying the basket 10 to a stripper operating mechanism 27 which is only indicated diagrammatically in FIGS. 1 and 2 but which is illustrated in more detail in FIG. 5 described further hereinafter.

In one embodiment there are three equally spaced lifters with three equally spaced ropes 26 located midway between adjacent lifters, respectively.

When stripping is required, the stripper operating mechanism 27 is arranged to pull on the ropes 24 so that instead of following the profile of the interior of the basket (as in FIG. 1) they each take up the position of a straight line between the basket opening 12 and the location where they pass through the rear wall 22 (as in FIG. 2). In taking up these new positions, the ropes 26 pull the lining bag 24, and hence the load, radially inwards, thus breaking up the cake formation and collapsing the load which can then be easily removed through the front opening 12.

The function of the ropes 26 is thus to pull the load away from the basket wall 20. The function of the lining bag is two-fold. It spreads the load applied by the ropes over a larger surface area but its main function is to prevent the load from becoming entangled with the ropes 24.

Figure 4:
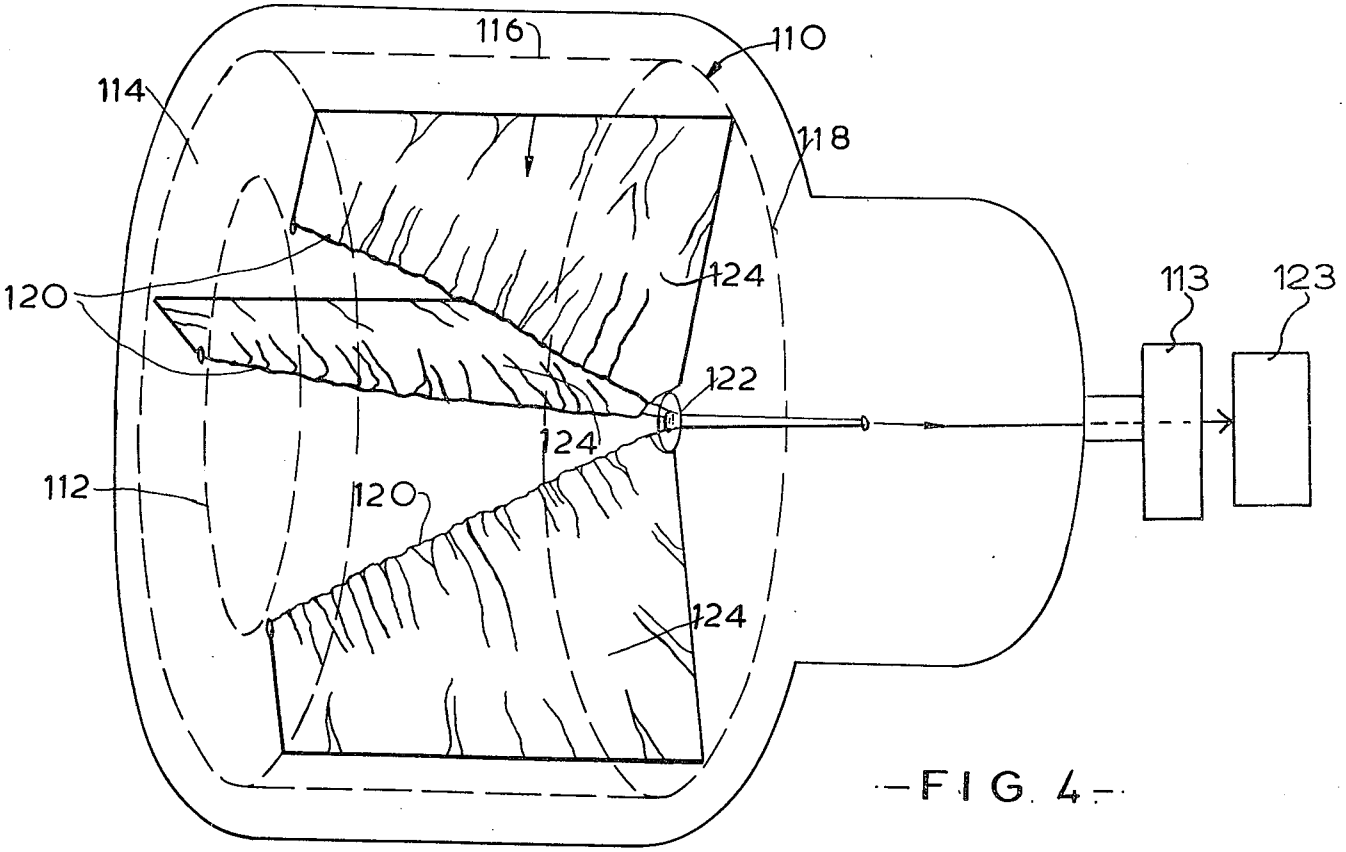
FIG. 4 is a diagrammatic perspective view similar to FIG. 3 but showing the stripping ropes in their activated positions.

The second embodiment illustrated in FIGS. 3 and 4 comprises an extractor basket 110, shown diagrammatically in the drawings, having an open mouth 112 for the insertion and removal of a load of laundry (not shown) and is adapted to be rotated in a conventional manner about a horizontal axis by a motor 113. The interior of the basket 110 is defined by an annular, radially extending front wall 114, a cylindrical side wall 116 and a circular, radially extending rear or base wall 118, the cylindrical side wall 116 being perforated to allow centrifuged fluid to pass therethrough during operation of the extractor.

A plurality of ropes 120, of which there are three in the present embodiment, are provided, one end of each rope 120 being attached to the basket 110 in the region of its mouth 112 and the other end passing through an aperture 122 in the centre of the rear wall 118 to a stripper operating mechanism 123 located outside the basket. A respective length of strong flexible material 124, for example canvas, is fitted between each rope 120 and the interior surfaces of said front, side and rear walls of the basket. One method of fixing the fabric lengths to the interior surfaces of the basket is by the use of metal strips screwed to the inside of the drum so as to clamp a respective edge portion of the fabric length to the basket.

The arrangement is such that when the extractor is activated the tension in the ropes is relaxed so that the ropes lie along the interior walls of the basket as in FIG. 3, the canvas lengths likewise conforming substantially to the outline of the basket interior.

When stripping is required, the stripper operating mechanism 123 is arranged to pull on the ropes 120 so that they each take up the position of a straight line between the basket opening 112 and the location where they pass through the rear wall 122 (as in FIG. 4). In taking up these new positions, the ropes pull the associated fabric lengths radially inwards to form webs, lying in respective planes containing said straight lines and the longitudinal axis of the basket, thus breaking up the cake formation and collapsing the load which can then be easily removed through the open mouth 112.

The function of the ropes 120 is thus to pull the load away from the cylindrical basket wall 116 and the function of the fabric lengths 124 is to prevent the load from becoming entangled with the ropes 120.

In the present embodiment, where there are three such ropes and fabric lengths, the planes containing the fabric lengths in their taut condition are arranged to be angularly spaced at 120° intervals.

Figure 5:
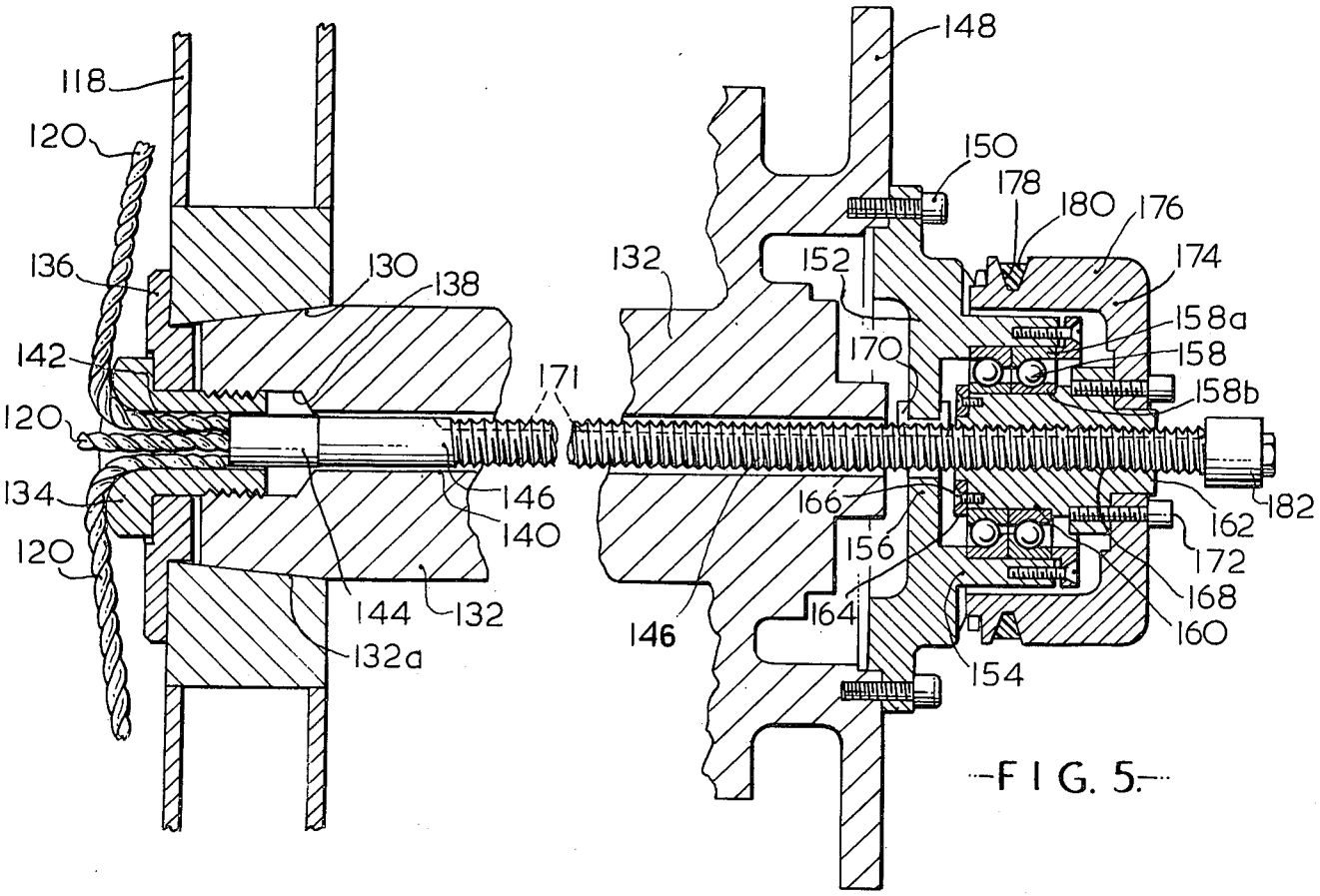
FIG. 5 is a sectional view illustrating one embodiment of a stripper operating mechanism for a washer extractor in accordance with the present invention.

FIG. 5 illustrates one example of a stripper operating mechanism suitable for use in either the embodiment of FIGS. 1 and 2 or the embodiment of FIGS. 3 and 4. However, for the present purposes, the stripper operating mechanism has been described in relation to the embodiment of FIGS. 3 and 4, utilising the reference numerals of that embodiment where appropriate.

With reference to FIG. 5, the rear wall 118 of the basket has a tapered, axially located bore 130 which receives a correspondingly tapered end portion 132*a* of a shaft 132, the rear wall 118 being clamped in position on the shaft 132 by means of a basket retaining setscrew 134 via a washer 136. The setscrew 134 has external screw-threads which are received in corresponding internal screw-threads in an enlarged portion 138 of an axial bore 140 in the shaft 132.

In the present embodiment there are three ropes 120 whose one ends are fixed to the mouth of the basket as shown in FIGS. 3 and 4. The other ends of the ropes 120 pass through an axial bore 142 in the setscrew 134 and are firmly attached to a cylindrical ferrule 144 which is slidable within the bore 140. The ferrule 144 is itself firmly attached to one end of an externally screw-threaded bar 146 which is longitudinally slidable in the bore 140 in the shaft 132.

Although not illustrated in FIG. 5 since it is not directly relevant to the present invention, the shaft 132 is connected intermediate its ends to a main drive means 113 whereby the shaft 132, and hence the basket can be selectively rotated for washing or centrifuging purposes.

The right hand end of the shaft 132 as viewed in FIG. 5, carries a brake disc 148 for cooperating with a corresponding set of brake shoes (not shown) and is further connected, by screws 150, to an annular support member 152 having a cylindrical portion 154 and a radial portion 156. The cylindrical portion 154 carries the outer race 158*a* of a ball bearing 158, the inner race 158*b* of which is mounted on the external surface 160 of a bush 162 by means of a clamping plate 164 and screws 166. The bush 162 has a screw-threaded bore 168 which is in screw-threaded engagement with the bar 146. Rotation of the bar 146 relative to the shaft 132 is prevented by means of a key 170 carried by the radial portion 156 of the support member 154 and engaging in an axially extending keyway in the surface of the bar 146.

The bush 162 is rigidly connected by screws 172 to a drive pulley 174 whose cylindrical surface 176 has a peripheral groove 178 for receiving a vee-belt 180 drivable by a stripper motor (not shown).

The right hand end of the bar 146, as viewed in FIG. 5, carries a permanent magnet 182 for actuating one or more reed switches serving as limit or position indicating elements for the bar 146.

During a normal washing or centrifuging operation, the basket is rotated by the main drive motor 113. In view of the connection of the shaft 132 via the key 170 to the bar 146, the bar 146, the ferrule 144 and the ropes 120 all rotate with the basket, as does also the bush 162 and drive pulley 174. The stripper motor is thus itself driven via the pulley 174 and vee-belt 180 under these conditions.

For stripping purposes, the basket is first brought to a halt by deactuating the main motor and actuating the disc brake. When the stripper motor is then actuated to drive the pulley 174, and hence the bush 162, relative to the shaft 132, the bar 146 is caused to be axially displaced to the right as viewed in FIG. 5 since rotation of the bar 146 is prevented by the key 170. Displacement of the bar 146 in this manner draws the ropes 120 into the setscrew bore 142 and hence effects the stripping action in the basket described hereinbefore. Reversal of the stripper motor to drive the bush 162 in the opposite direction is then effective to return the ropes 120 into the basket for a subsequent washing or centrifuging operation.

I claim:

1. A fluid extractor comprising a cylindrical basket having a base, generally cylindrical walls and a mouth opening opposite said base, means mounting said basket for rotation about its longitudinal axis for centrifugally extracting fluid from material placed therein, at least one elongated first flexible member having one end attached to said basket adjacent said mouth and having its other end extending out of said basket through an aperture in the central region of said base, a stripper actuating mechanism located externally of said basket and operably connected to said other end of said first flexible members, said stripper actuated mechanism being selectively operable between a first position permitting said elongated first flexible members to assume a position substantially conforming to the profile of said basket from said mouth to said aperture and a second position applying a tensile load to said first flexible members to withdraw a portion thereof through said aperture to thereby dislodge centrifuged material from the walls of said basket, and means for preventing entanglement of material in the basket with said first flexible members.

2. A fluid extractor according to claim 1 in which said means for preventing entanglement comprises at least one second flexible member fitted between said at least one first flexible member and the internal walls of the basket.

3. A fluid extractor according to claim 1 in which said means for preventing entanglement comprises a perforated lining bag distinct from said at least one first flexible member and located within the basket, said lining bag being of dimensions such that it can substantially take up the profile of the interior of the basket during centrifuging, said bag having an open mouth attached to the basket in the region of said basket mouth with said first flexible members lying in between the bag and the internal surfaces of the basket.

4. A fluid extractor according to claim 2 in which said second flexible member comprises a four-sided length of flexible material, one side being connected to said at least one elongated first flexible member and the other three sides being respectively connected to the basket wall containing said mouth, the cylindrical side wall and the basket base.

5. A fluid extractor according to claim 1 in which there is a plurality of said elongated first flexible members whose one ends are attached to the basket adjacent said mouth at respective first locations spaced at equal intervals around the mouth, and whose other ends pass through said aperture means in the basket base to said stripping mechanism.

6. A fluid extractor according to claim 1 in which said stripping mechanism comprises a member which is mounted for controlled movement parallel to the rotational axis of the basket and to which said other end of each first flexible member is attached.

7. A fluid extractor according to claim 6 in which said means mounting the basket comprises a shaft which supports the basket for rotation about its longitudinal axis, and an axial bore in said shaft, and wherein said stripping mechanism comprises an externally screw-threaded bar which is mounted for longitudinal sliding movement in said axial bore in said shaft, a key preventing rotational movement of the bar relative to said shaft, and a selectably rotatable bush having internal screw threads in engagement with the screw-threads on said bar.

8. A fluid extractor according to claim 7 further comprising a pulley connected to said bush and an electric motor and belt drive for selectively rotating said pulley in either direction.

9. A washer extractor comprising a basket having generally cylindrical side walls, a base, and an end wall having a mouth therein opposite said base, means mounting said basket for rotation about its longitudinal axis for washing and fluid extracting operations on material placed therein, a plurality of ropes each having one end attached to said basket in the region of said mouth and having their other ends extending out of said basket through an aperture in the central region of said base, a stripping mechanism located externally of said basket and operably connected to said other ends of said ropes, said stripping mechanism being selectively operable to draw said other ends of said ropes through said apertures to thereby adjust the tension in said ropes for dislodging the centrifuged material from the walls of said basket, and means for preventing entanglement of material in the basket with said ropes.

* * * * *